US008139814B2

(12) United States Patent
Rottenberg et al.

(10) Patent No.: US 8,139,814 B2
(45) Date of Patent: Mar. 20, 2012

(54) AUDIO SPEAKER WITH RADIAL ELECTROMAGNET

(76) Inventors: William B. Rottenberg, Durango, CO (US); Robert S. Robinson, Galena, KS (US)

( * ) Notice: Subject to any disclaimer, the term of this patent is extended or adjusted under 35 U.S.C. 154(b) by 851 days.

(21) Appl. No.: 12/169,540

(22) Filed: Jul. 8, 2008

(65) Prior Publication Data

US 2009/0067665 A1 Mar. 12, 2009

Related U.S. Application Data

(60) Provisional application No. 60/948,590, filed on Jul. 9, 2007.

(51) Int. Cl.
*H04R 11/02* (2006.01)

(52) U.S. Cl. ..... 381/412; 381/400; 381/401; 381/402; 381/414; 381/419; 381/420; 381/421; 381/422; 29/594; 335/213

(58) Field of Classification Search ..... None
See application file for complete search history.

(56) References Cited

U.S. PATENT DOCUMENTS

| | | | | |
|---|---|---|---|---|
| 7,006,654 | B2 * | 2/2006 | Stiles et al. | 381/412 |
| 7,859,144 | B1 * | 12/2010 | Sahyoun | 310/15 |
| 2006/0182303 | A1 * | 8/2006 | Trandafir | 381/409 |
| 2006/0208600 | A1 * | 9/2006 | Sahyoun | 310/254 |

* cited by examiner

*Primary Examiner* — Charles Garber
*Assistant Examiner* — Yasser Abdelaziez
(74) *Attorney, Agent, or Firm* — John R. Merkling

(57) ABSTRACT

An audio speaker with at least two electric coils on opposite sides of at least one ferro-magnetic plate, the coils and plate forming a radial electro-magnet. A radial electro-magnet can offer many advantages in stereo loudspeakers. The coils are electrically driven in opposite directions. Multiple sets of two coils and intervening ferro-magnetic plate may be provided, adjacent sets being separated by a non-magnetic plate.

12 Claims, 8 Drawing Sheets

AUDIO SPEAKER WITH RADIAL ELECTROMAGNET

A novel orientation of two electric coils is described that allows easy generation of a radial magnetic field, which can be used to build a radial electro-magnet. A radial electro-magnet can be used in stereo loudspeakers to offer many advantages. This method can also be used in the production of permanent radial magnets and other applications that require radial magnetic fields.

BACKGROUND

Many applications require a radial magnetic field (one pointing between the center and the circumference of a circle, along a radial line). One significant use of a radial magnetic field is in the design of a standard loudspeaker. A radial magnetic field creates a magnetic flux through the voice coil windings and generates a force in response to a current through the voice coil which moves the voice coil and the attached sound surface. Current loudspeakers use standard ring magnets (which generate an axial magnetic field) and channel the magnetic field into a radial direction using ferro-magnetic materials. This channeling weakens the magnetic field and reduces the efficiency of the loudspeaker. An alternative system uses wedge-shaped magnets that are glued together to create a radial magnetic field, but this is a complex process and has limited magnetic field potential.

Loudspeakers can require high power to drive them for several reasons, including the ability to move fast and long distances. Existing systems use a voice coil attached to the sound generator (cone), moving in the magnetic field of a fixed magnet-generated gap. The fixed magnet is of limited strength, so the bulk of the power is generated by passing a high current through the voice coil. This has several negative effects. The coil wires must pass high current, forcing them to be thicker. The larger wire puts less turns within the magnetic field, decreasing the force generated to move the voice coil. The increased wire thickness increases the mass of the voice coil, which increases the momentum and opposes changes in motion, requiring more force to move the coil. Finally, the high power causes heat, which forces design complications. Additionally, the requirement for a high power drive signal increases the complexity and cost of the amplifier that must provide this signal.

Loudspeakers typically use an overhung design, meaning the voice coil is longer than the magnetic field gap it moves through. This is because the length of travel that the voice coil has (its throw) is defined by the length of the overlap between the voice coil and the magnetic field gap it travels in. It is difficult to build long magnetic field gaps that are both strong and have a linear magnetic field through the gap, so the throw is increased by making the voice coil longer. This is inefficient because the voice coil has many wasted turns that are not within the magnetic field at any given time, not generating any force but increasing the coil resistance and the coil weight, both wasting power. There are also non-linearities in the magnetic fields around the ends of the voice coil and the magnetic field gap, both of which can cause distortion. To avoid this, the voice coil must be further lengthened to keep the end zones out of the throw of the voice coil. An underhung design, one where the magnetic gap is longer and the voice coil is short, is more efficient because it allows the voice coil to be lighter. The throw is defined by the length of the magnetic gap.

BRIEF DESCRIPTION OF INVENTION

The system invented uses a novel orientation of two electric coils to generate the radial magnetic field required to build a radial electro-magnet. The same coil assembly could be used to build permanent radial magnets by generating the appropriate magnetic field during production of the magnets.

An electro-magnet is generally built by winding a coil around a ferro-magnetic rod. This configuration creates an axial electro-magnet with the poles at each end of the rod. It is not currently possible to easily build a radial electro-magnet, since this would require wrapping the coil around and through a doughnut shaped core. We discovered that two coils can be placed one on top and one below the core and if the current is passed in the opposite direction through each coil, the proper magnetic field is generated to create a radial electric field.

DETAILED DESCRIPTION OF INVENTION

Figure 1:
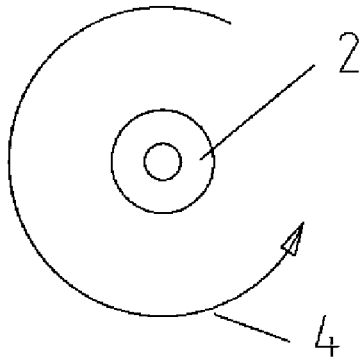
FIG. 1 is a graphical representation of a magnetic field around a single wire.
Figure 2:
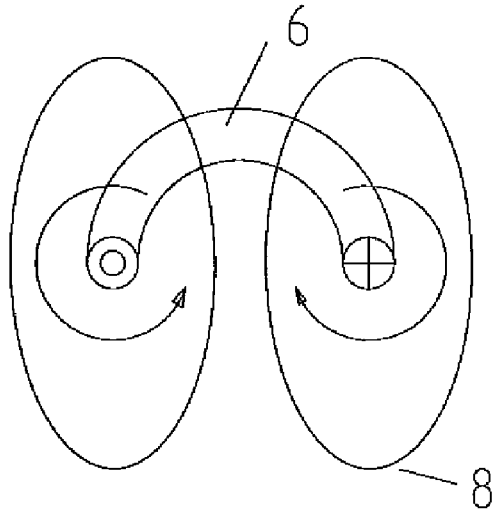
FIG. 2 is a graphical representation of a magnetic field around a cross section of a coil.
Figure 3:
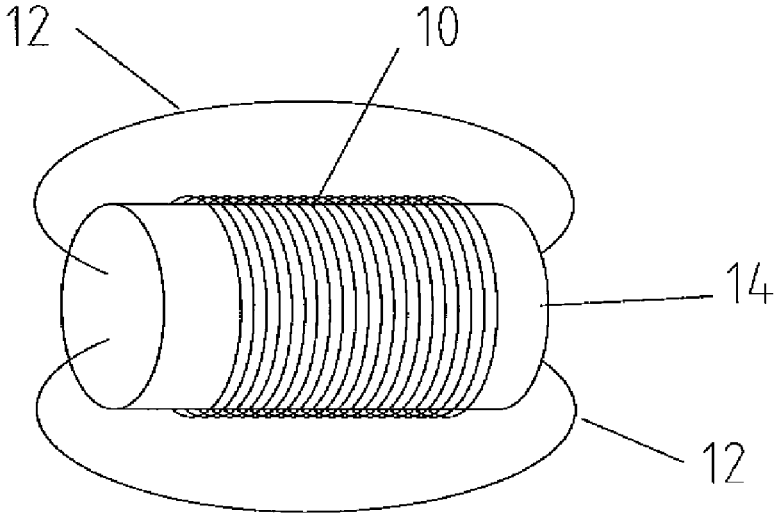
FIG. 3 is a perspective representation of a magnetic field around an axial electro-magnet.

A magnetic field 4 is generated around a wire 2 with a current passing through it (FIG. 1). When several wires are placed near each other (as in a coil), the magnetic fields are added and strengthened (FIG. 2), and if a ferro-magnetic core is added, the fields are channeled through the core and further strengthened. FIG. 2 shows a magnetic field 8 around a coil 6, in cross section. The circle and cross inside the coil 6 follow the convention that the current flows towards the circle or dot (the head of the arrow) and away from the cross or "x" (the tail of the arrow). This principle is used to create the typical axial electro-magnet. While there are magnetic flux fields all around the windings, the strongest ones lie along the highest concentration of windings and through the core (FIG. 3). FIG. 3 illustrates an axial electro-magnet 10. The magnetic field 12 runs perpendicular to the coil windings 10, thus going through the length of the core 14, which strengthens the field.

Figure 4:
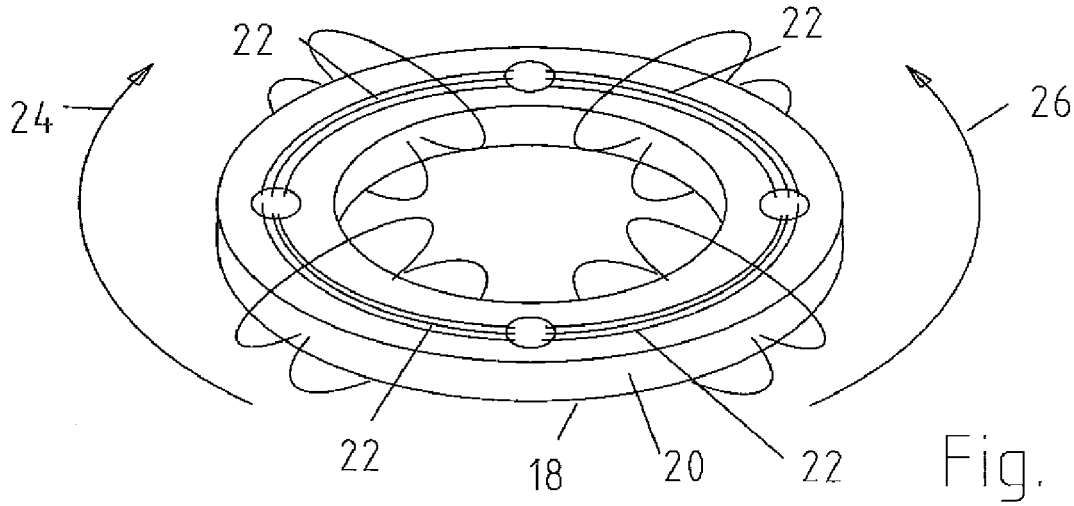
FIG. 4 is a perspective view of a prior art radial electro magnet.

An open air coil generates a magnetic field with flux lines running through the center (as would be used with an axial electro-magnet) but also radially (since the flux field is around the wires). The radial field is naturally weaker since it is not concentrated by the geometry of the coil. A radial magnet needs the magnetic field to run along a radial line from the center to the circumference. Applying the same principles used to build an axial electro-magnet would require many coils wrapped through the core (FIG. 4). FIG. 4 illustrates traditional logic applied to build a radial electro-magnet 18. The doughnut-shaped core 18 is divided into axial segments with wire 22 wrapped around each segment. Top current 24 flows in one direction (for example, clockwise), while bottom current 26 flows in the opposite direction (for example, counter clockwise) in the bottom windings (not shown). This is obviously difficult or impossible to do practically.

Figure 5:
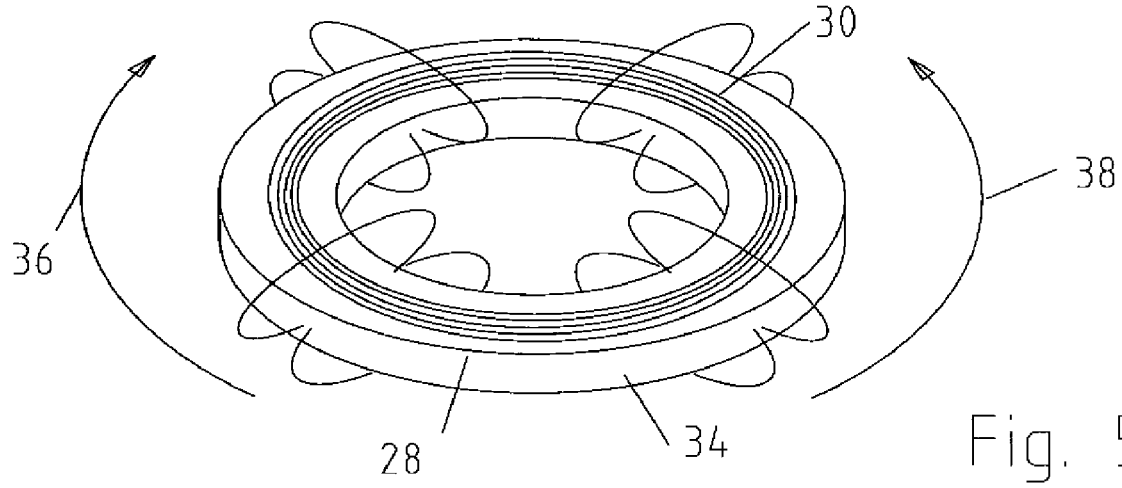
FIG. 5 is a perspective view of a radial electro-magnet according to the present invention.
Figure 6:
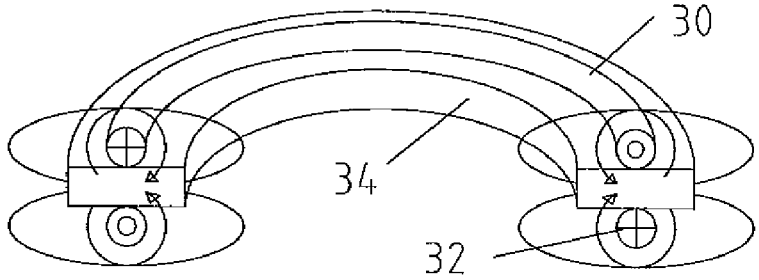
FIG. 6 is a sectional view of the radial electro-magnet of FIG. 5, showing a single coil.

We discovered that by placing two coils 30, 32 (FIG. 6), with the current running in opposite directions, next to each other, a radial field is generated between the coils (FIG. 5). By further adding a doughnut shaped core 34 in this plane, the radial magnetic field becomes the significant one, rather than the axial field used in rod electro-magnets (FIG. 6). FIG. 5 shows a radial electro-magnet 28 using coils 30, 32 placed above and below the core 34. Top current 36 flows in one direction (for example, clockwise), while bottom current 38 flows in the opposite direction (for example, counter clockwise).

Figure 7:
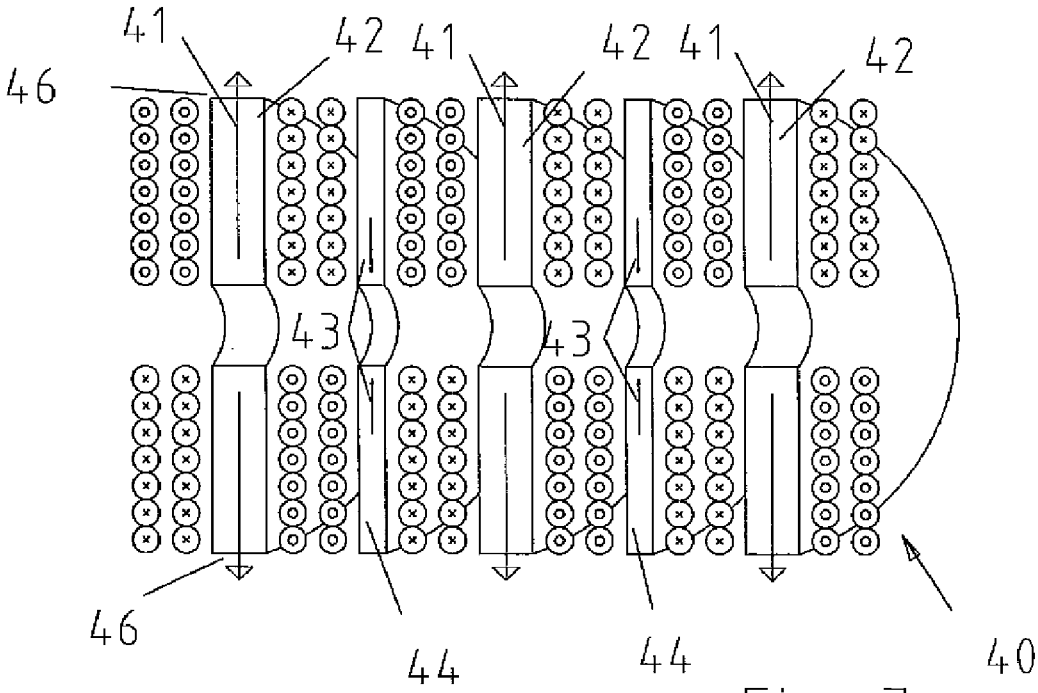
FIG. 7 is a cross sectional view of an assembly of stacked radial electro magnets.
Figure 8:
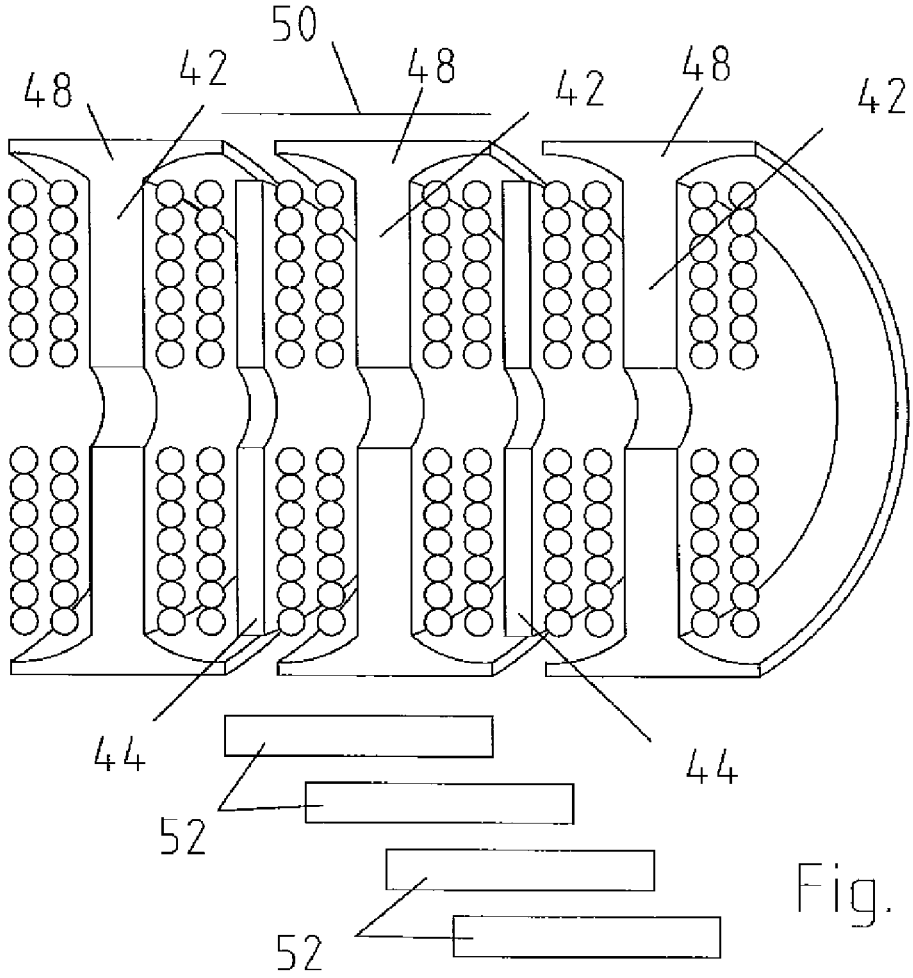
FIG. 8 is a cross sectional view of an assembly of stacked radial electro-magnets with an adjacent voice coil shown in a plurality of positions.
Figure 9:
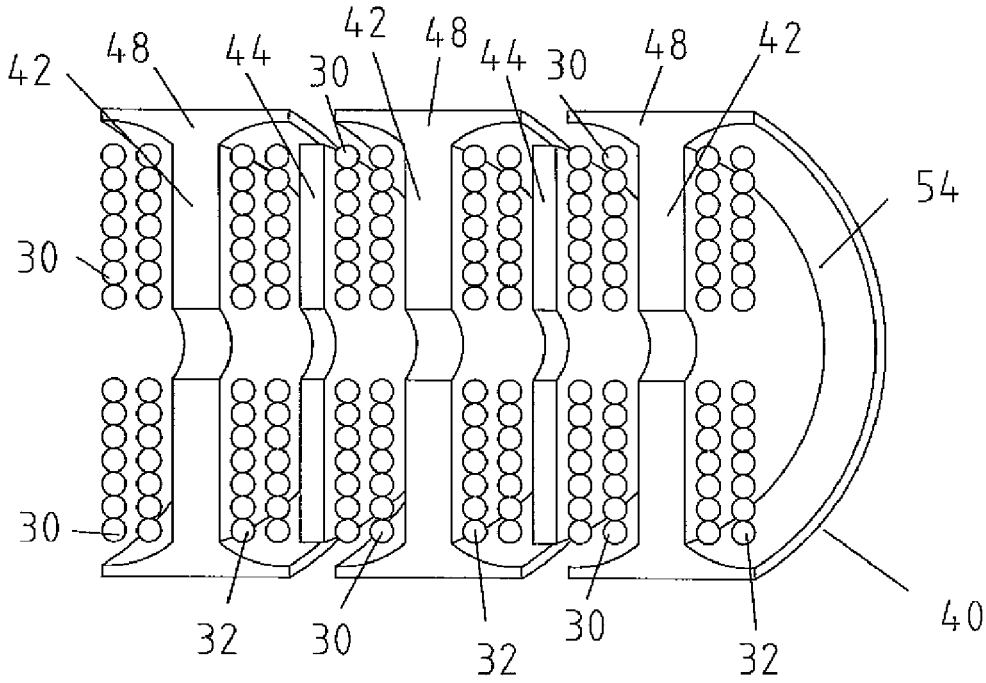
FIG. 9 is a cross sectional view of an assembly of stacked radial electro-magnets with shaped channels.
Figure 10:
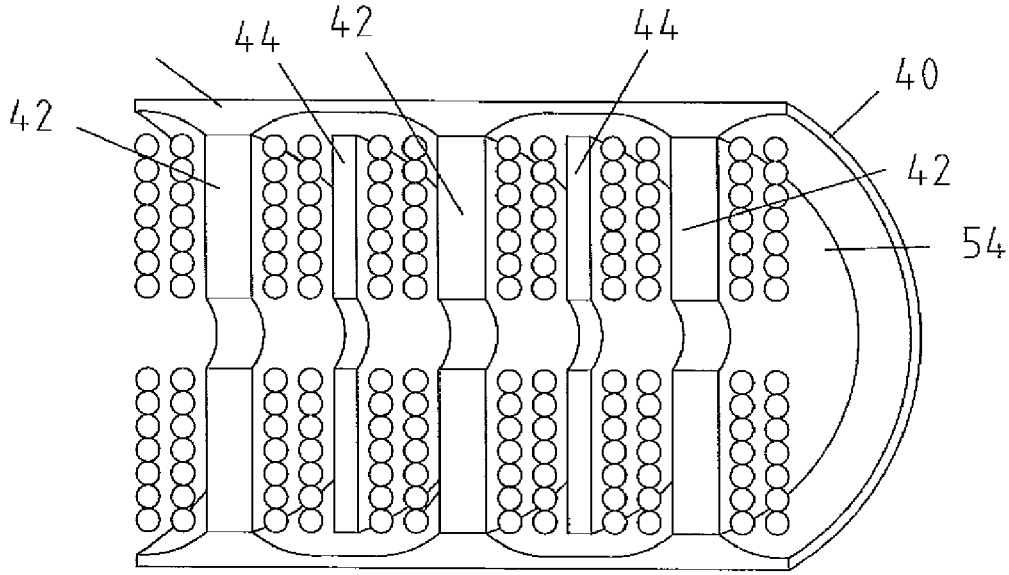
FIG. 10 is a cross sectional view of an assembly of stacked radial electro-magnets with a continuous outer layer.

This radial electro-magnet assembly 28 has an inherently limited thickness, because the thicker the core 34, the lower the flux density is within the core, and the efficiency decreases. This non-ferro-magnetic layer is required because an opposing radial magnetic field is be generated between the assemblies, and the non-ferromagnetic core will not reinforce this field. FIG. 7 shows stacked radial electro magnets 40. Ferro-magnetic cores 42 provide strong fields 41, while non-ferro-magnetic spacers 44 do not reinforce fields 43. The gap 46 between assemblies can also be longer to further reduce this field. If this is applied to a system with a moving coil in the magnetic field, as long as the coil length is a multiple of the length of one assembly, all non-linearities within the field, including the reverse field, are constant through the throw of the coil and the magnetic field appears linear (FIG. 5). In this way, theoretically endless radial magnetic fields can be built. As shown in FIG. 8, the ferro-magnetic cores 42 may comprise flanges 48. A magnetic assembly limit length, shown in FIG. 8, may be defined as the linear axial distance between two similar features, for example, the left-hand edge of a flange to the left-hand edge of an adjacent flange. In FIG. 8, voice coils 52 are shown in various positions. Notice that for all the various voice coil positions, the voice coil 52E overlaps exactly one magnetic assembly unit. In this way, any non-linearity in the magnetic field within the assembly unit are integrated out. The magnetic core pieces of the electro-magnet can be shaped to improve the linearity of the magnetic field throughout the gap (FIG. 9) and can even be designed to be continuous (FIG. 10). FIG. 9 shows stacked magnetic assemblies with shaped channels 54 to enhance field linearity. Beams can take a variety of shapes depending on the configuration, all intended to linearize the magnetic field. FIG. 10 shows stacked magnetic assemblies with a continuous outer layer 56.

This can be applied to several fields, but specifically to the stereo loudspeaker field the opportunities are numerous.

There is an inherent conflict within the design of the traditional voice-coil assembly. Loudspeakers sometimes require great force to move the sound generator (cone), especially within the lower frequency ranges where long throws are requited to generate the large sound pressures demanded for intense volume. The conflict is that in order to increase the force to move the voice coil, the current running through the voice coil must be increased. This is because the force generated to move the voice coil is defined by F=itB, where F is the moving force, i is the current through the coil, t is the number of turns within the magnetic field and B is the strength of the magnetic field. In order to increase F, i, t or B must be increased. B, the field strength, would be the logical choice, but it is currently generated by fixed magnets and channeling magnetics that are limited in power and efficiency. t can only be increased by lengthening the magnetic field gap (not practical with the current magnetics used) or by decreasing the thickness of the wire or wrapping multiple layers. The wire thickness cannot be decreased without increasing the resistance (opposing current, i, and decreasing the ultimate F) and reducing the current capacity of the wire (decreasing the maximum i that the wire can carry and again decreasing the ultimate F). Multiple layers dictate an increase in the width of the magnetic field gap, decreasing the strength of the field and, again, decreasing the force generated. This also increases the mass of the voice coil, yet again opposing the motion and requiring more force. Increasing i forces the wire to be thicker, increasing the weight (working against the moving F) and reducing t (once again decreasing the ultimate F). Increasing i also creates power dissipation and heating issues for the voice coil, as well as increasing demands on the amplifier driving the loudspeaker. Using the radial electro-magnet, the magnetic field can be strengthened allowing the voice coil to carry less current. Increasing the strength of the magnetic field simply requires a large DC current, which can be passed through very thick wires. The same formulae govern this power, and similar design constraints exist, but since this is not a moving part, the issues of weight and momentum are eliminated. Additionally, this signal is simply DC, since it is not the driving signal, so the fidelity requirements are much easier to address. The current through the voice coil can be decreased, allowing thinner wire which can both decrease the weight of the voice coil and increase the number of turns within the magnetic field (t), serving to further increase the force generated. The lower power also reduces the power dissipation issues (heating) for the voice coil as well as relieving the design requirements for high power amplifiers to drive the loudspeaker.

Since the magnetic field is generated electrically, its field strength can be varied, if desired. In fact, an interesting loudspeaker could be built where the driving current is fed through the magnetic field and the current through the voice coil is fixed. The current would have to be high, but the constraints are different since this coil does not have to move. It can use big, thick and heavy wire without the negative effects on the moving voice coil. In reality, a combination of the two would be useful, such as when large and fast movements are required of the vaicc coil, a combination of signals could be sent to both the voice coil and the electro-magnet coils to facilitate this movement.

Figure 11:
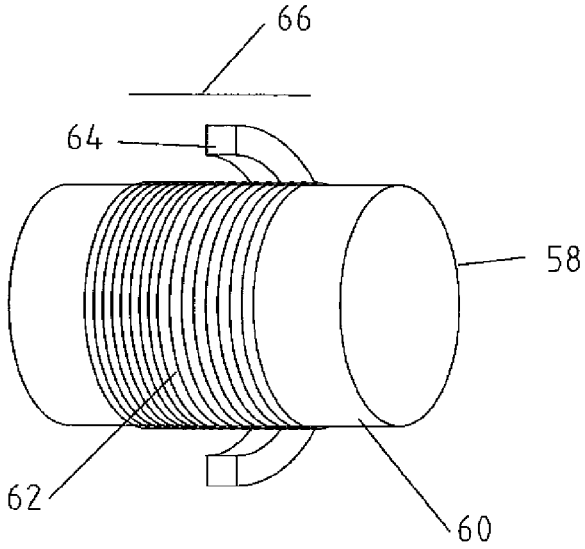
Prior Art Fig. 11
FIG. 11 is a perspective view of an overhung voice coil assembly (prior art).
Figure 12:
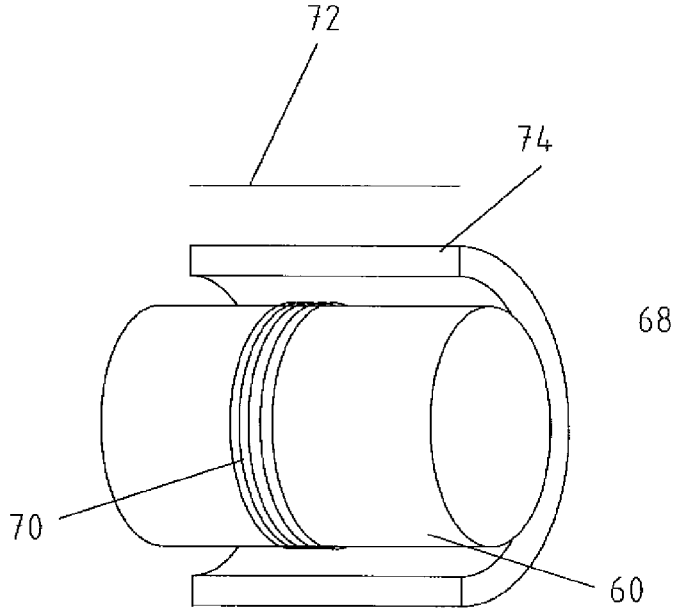
Prior Art Fig. 12
FIG. 12 is a perspective view of an underhung voice coil assembly (prior art).

With this new ability to build long radial magnetic fields, the benefits of a true underhung loudspeaker can finally be achieved. An overhung voice coil assembly is currently the most common configuration because generating long, consistent magnetic gaps is not possible or practical. The overhung design uses the length of the voice coil to drive the speaker's throw 66 (FIG. 11). An overhung voice coil assembly comprises a voice coil former 60 supporting a voice coil 62 and surrounded by a relatively narrow circular magnet 64. An underhung design 68 (FIG. 12), is more efficient because it lets the voice coil 70 be short, reducing weight and coil resistance, both of which will increase speaker efficiency. The underhung design requires a long magnetic field gap, which is possible with this invention. The throw 72 is defined by the length of the circular magnet 74.

Figure 13:
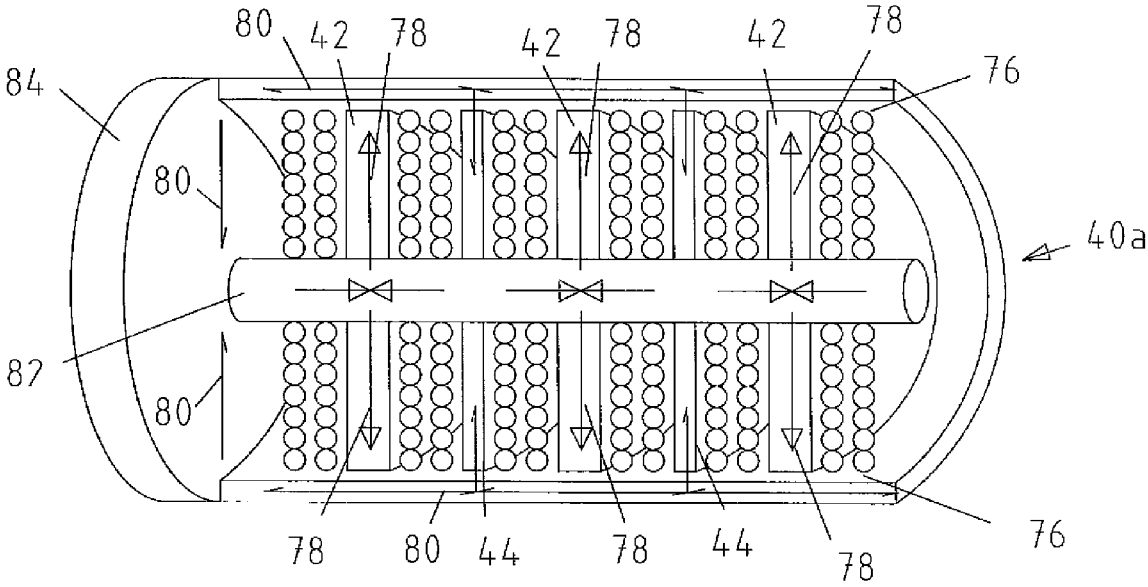
FIG. 13 is a cross sectional view of an assembly of stacked radial electro-magnets with the assembly inside a magnetic gap.
Figure 14:
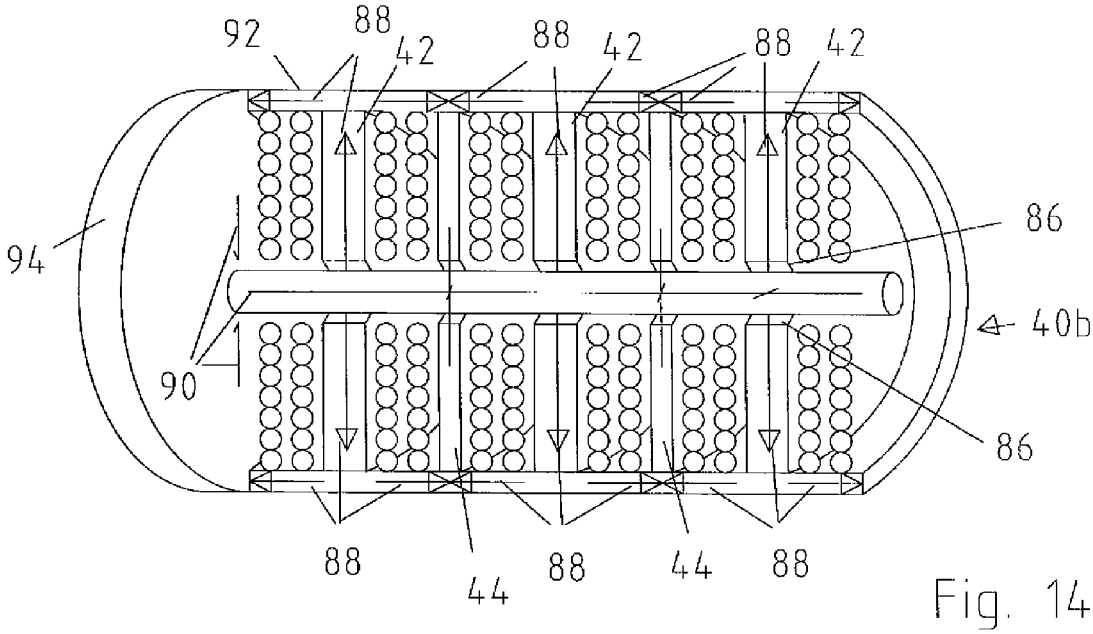
FIG. 14 is a cross sectional view of an assembly of stacked radial electro-magnets with the assembly outside a magnetic gap.

The magnetic gap can be placed outside the electro-magnet 40*a* (FIG. 13) or within the electro-magnet 40*b* (FIG. 14). FIG. 13 is an example of a magnetic gap 76 generated with the electro-magnet 40 inside the gap. The large arrows 78 represent induced magnetic fields, while the small arrows 80 show magnetic field channeling. A center rod 82 and a pole piece 84 are also shown. FIG. 14 is an example of a magnetic gap 86 generated with the electro-magnet 40 outside the gap. The large arrows 88 represent induced magnetic fields, while the small arrows 90 show magnetic field channeling. An outer tube 92 and a pole piece 94 are also shown. In either case, the pole piece and the return path (center rod or outer tube) enhance the magnetic field through their proximity to the electro-magnet coils. The center rod forms several traditional axial rod magnets from the coils wrapped around them, and the outer tube strengthens the magnetic field in the same, although less obvious or common way. In this way, even the channeling magnetics are not entirely passive.

Figure 15:
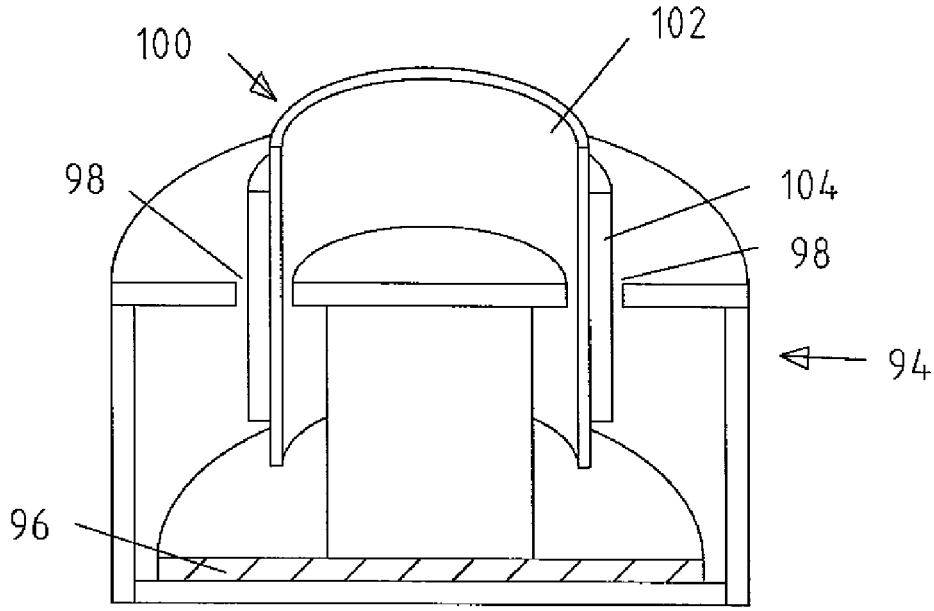
Prior Art Fig. 15
FIG. 15 is a cross sectional view of a speaker configuration (prior art).

A traditional speaker assembly 94 uses an axial magnet 96 and channels the magnetic field to gap 98 (FIG. 15). The speaker assembly has a movable voice coil assembly 100 comprising a voice coil former 102 with circumferential voice coil windings 104.

Figure 17:
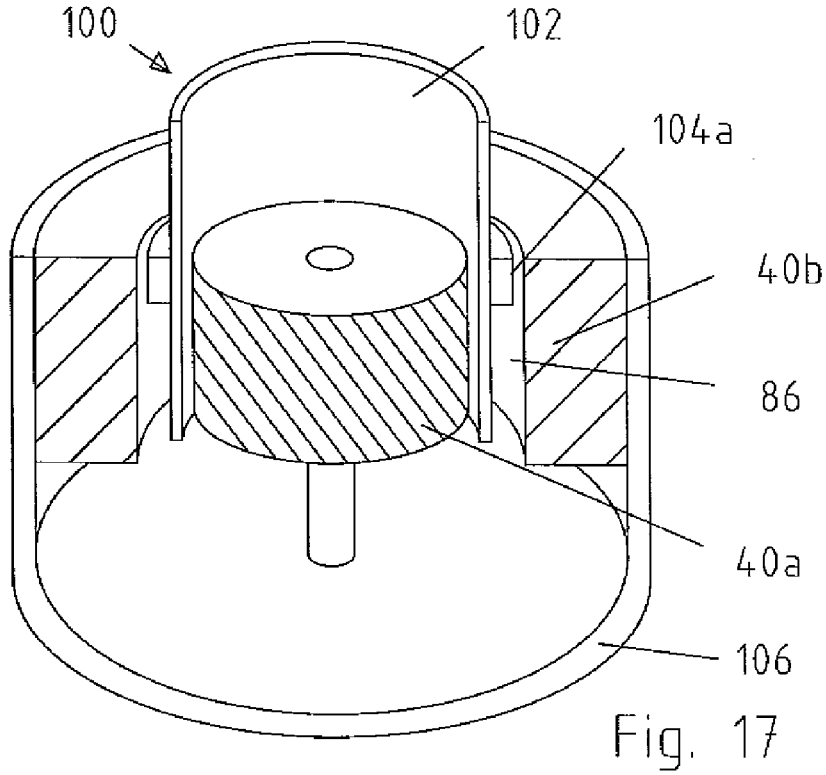
FIG. 17 is a cross sectional view of a speaker configuration with a radial electro-magnet assembly inside a voice coil assembly and a radial electro-magnet outside the voice coil assembly.
Figure 16A:
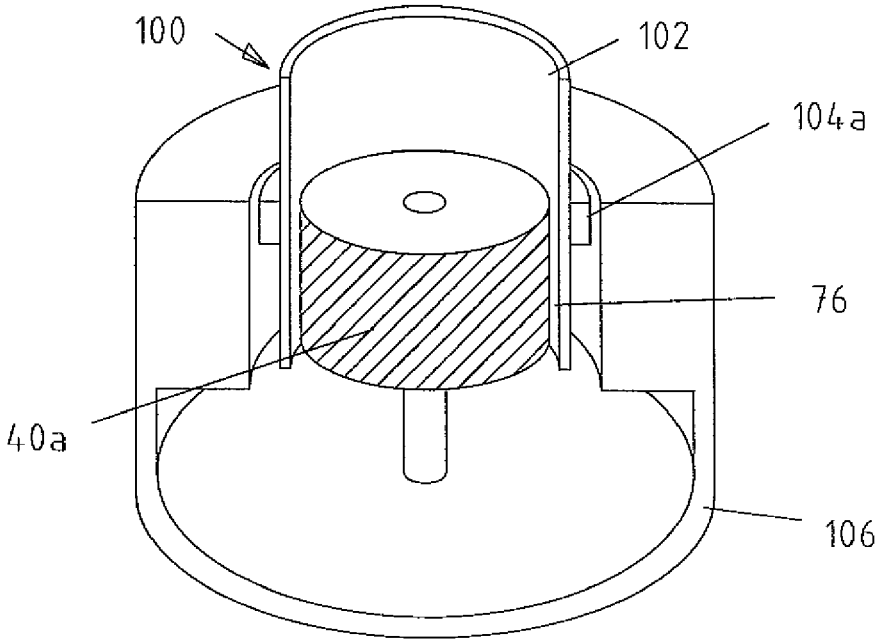
FIG. 16*a* is a cross sectional view of a speaker configuration with a radial electro-magnet assembly inside a voice coil assembly.
Figure 16B:
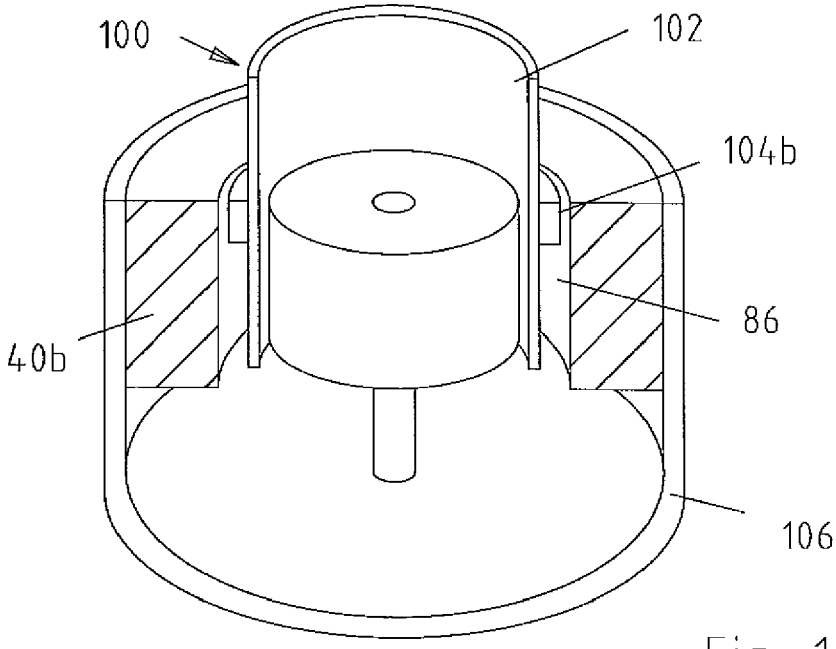
FIG. 16*b* is a cross sectional view of a speaker configuration with a radial electro-magnet assembly outside a voice coil assembly.

Using this radial electro-magnet 40, or permanent radial magnets, the assembly can use the radial magnets 40*a*, 40*b* either inside the voice coil 104*a* (FIG. 16*a*), or outside the voice coil 104*b* (FIG. 16*b*). Either assembly uses magnetic field channeling 106 to create one pole of the magnetic field gap 76, 86. Placing the magnetics outside the voice coil assembly 100 allows the voice coil to be smaller diameter but requires a larger magnetic assembly 40*b*. There will be advantages for either configuration. A stronger magnetic field can be generated by using two magnetic assemblies 40*a*, 40*b*, one 40*a* inside and one 40*b* outside the voice coil assembly 100 (FIG. 17). With this configuration, no magnetic field channel is required as the gap is generated between two magnets. The components 106 shown are only to hold the assembly together.

Key Ideas

A configuration to build a radial electro-magnet.

A coil configuration to build a permanent radial magnet.

A method to build a long radial electro-magnet (stacking assemblies).

A loudspeaker using radial magnets (electro or permanent, either inside the voice coil, outside the voice coil, or both).

A method to build a very strong magnetic field, allowing the voice coil power to be reduced. This provides several advantages over current systems:

The static magnetic field only requires high DC current, while the speaker drive signal can be low power. This simplifies amplifier design and reduces cost. High power through the non-moving electro-magnet can use thicker wire without deleterious effect.

The lower power through the voice coil allows thinner wire, reducing the weight of the voice coil and improving efficiency.

The lower power through the voice coil allows thinner wire, placing more windings within the magnetic field and increasing force and efficiency.

weight of the voice coil and improving efficiency.

A long-throw loudspeaker using a short and/or low power voice coil (for low weight and/or power) and an underhung design.

A loudspeaker using an electro-magnet to generate the magnetic field which allows the field to be varied with the drive signal as well as, or possibly instead of, the voice coil. Since this part does not move, some of the design constraints with high-power voice coils are eliminated. In practice, drive signals to both the voice coil and the electro-magnet coils is interesting.

The invention claimed is:

1. An audio speaker comprising at least one ferro-magnetic plate, said plate lying in an axial plane extending radially from an axis, at least two electric coils on opposite sides of said ferro-magnetic plate, each of said coils extending radially outward from said axis such that there are more windings in the axial plane than along said axis, whereby the coils and plate form a radial electro-magnet.

2. The audio speaker according to claim 1 wherein each of said ferro-magnetic plates comprise a flange at an outer edge of said plate.

3. The audio speaker according to claim 2 wherein said flanges are joined into a continuous outer layer.

4. An audio speaker comprising a plurality of sets of two electric coils and an intervening ferro-magnetic plate, said electric coils being on opposite sides of said ferro-magnetic plate, adjacent sets being separated by a non-magnetic plate.

5. The audio speaker according to claim 4 wherein the ferro-magnetic plate is a toroid shape.

6. The audio speaker according to claim 5 wherein the coils are concentrically wound around a common axis with said toroid ferro-magnetic plate.

7. The audio speaker according to claim 4 wherein each of said ferro-magnetic plates comprise a flange at an outer edge of said plate.

8. The audio speaker according to claim 7 wherein said flanges are joined into a continuous outer layer.

9. A method of making an audio speaker comprising providing at least one ferro-magnetic plate, said plate lying in an axial plane extending radially outwardly from an axis, forming at least two electric coils, one coil on one side of said ferro-magnetic plate and the other coil on an opposite side of said ferro-magnetic plate, causing each of said coils to extend radially outward from said axis such that there are more windings in the axial plane than along said axis, whereby the coils and plate form a radial electromagnet.

10. A method of making an audio speaker comprising providing a plurality of sets of two electric coils and an intervening ferro-magnetic plate, one coil on one side of said ferro-magnetic plate and the other coil on an opposite side of said ferro-magnetic plate, the coils and plate forming an electromagnet, adjacent sets being separated by a non-magnetic plate.

11. The method according to claim 10 wherein the ferro-magnetic plate is a toroid shape.

12. The method according to claim 11 further comprising winding the coils concentrically around a common axis with said toroid ferro-magnetic plate.

* * * * *